United States Patent [19]

Koehm

[11] 4,359,244

[45] Nov. 16, 1982

[54] FOLDING CHAIR

[76] Inventor: Ronald E. Koehm, 27703 Ortega Hwy., #11, San Juan Capistrano, Calif. 92675

[21] Appl. No.: 171,208

[22] Filed: Jul. 22, 1980

[51] Int. Cl.[3] ..... A47C 4/00; A47D 1/02

[52] U.S. Cl. ..... 297/16; 297/42; 297/45

[58] Field of Search ..... 297/16, 42, 43, 44, 297/45, 59, DIG. 6

[56] References Cited

U.S. PATENT DOCUMENTS

| | | | |
|---|---|---|---|
| 400,357 | 3/1889 | O'Hare | 297/44 X |
| 703,077 | 6/1902 | Nivison | 297/44 |
| 971,738 | 10/1910 | Engstrom | 297/44 |
| 1,939,743 | 12/1933 | Warner | 297/42 |
| 1,963,835 | 6/1934 | Deland | 297/14 |
| 3,390,893 | 7/1968 | MacLaren | 297/45 X |

*Primary Examiner*—James T. McCall
*Attorney, Agent, or Firm*—Fischer, Tachner & Strauss

[57] ABSTRACT

A unique folding chair having a frame which permits said chair to be easily and conveniently folded into a compact configuration that facilitates both the storage and transport thereof. The frame of the instant folding chair includes a triangular-shaped seat support structure and an arrangement of legs that are spaced relative to one another in positions that correspond to the vertices of a triangle. By virtue of particular coupling assemblies, the structural members of the folding chair of the present invention are adapted to be moved in one or both of two perpendicular directions. Accordingly, the chair may be folded so that the structural members thereof can be arranged in substantially parallel alignment with one another and generally in a single plane.

17 Claims, 7 Drawing Figures

FOLDING CHAIR

BACKGROUND OF THE INVENTION

1. Field of the Invention

This invention relates to a unique folding chair having a frame which permits each of the structural members thereof to be compactly folded into substantially parallel alignment with one another and generally in a single plane.

2. Prior Art

Folding chairs have long been available for utilization both at home and in recreational endeavors. Such conventional folding chairs are typically constructed with an arrangement of legs and a seat support that are substantially rectangular in alignment and configuration. However, the conventional folding chair has several major shortcomings. When folded, the structural members thereof are arranged in either of two perpendicular directions, so that the conventional chair retains its generally rectangular configuration. Consequently, undesirably large amounts of space are consumed in the folded configuration, thereby making said chair unsuitable for placement in closets, attics, and the like, wherein access to available storage area is limited. Moreover, the relatively large rectangular folded configuration is inconvenient when the conventional chair is to be transported in an automobile having minimal luggage or storage area. What is more, carrying one or more of said conventional chairs by hand may be a cumbersome and difficult task, especially when the user must also carry additional items at the same time. When being used in an upright or unfolded configuration, many conventional folding chairs are known to become unstable when they are shoved, subjected to vibrations, or when other physical forces are exerted thereupon. What is still more, the construction and the corresponding shape of many of the conventional folding chairs may, in their unfolded or upright conditions, feel generally uncomfortable to the user.

Examples of conventional seating devices, such as those with the shortcomings described above and which devices are adapted to be placed in either one of a folded or unfolded condition, can be found in the following U.S. patents:

U.S. Pat. No. 484,240—Oct. 11, 1892

U.S. Pat. No. 2,783,825—Mar. 5, 1957

U.S. Pat. No. 4,062,555—Dec. 13, 1977

However, neither the seating devices in any of the aforementioned patents nor any other folding chair is known in which each of the structural members thereof can be compactly folded into substantially parallel alignment with one another by moving said members in one or both of two perpendicular directions.

SUMMARY OF THE INVENTION

Briefly, and in general terms, a unique folding chair is disclosed having a frame which permits the chair to be easily folded in one or both of two perpendicular directions to form a compact configuration that facilitates both the storage and the transport thereof. The frame of the present folding chair comprises the interconnections of front and back legs, seat support members, back support members, and arm support members. The front and back legs of the chair are positioned relative to one another, whereby to form the vertices of a triangle. The seat support members are arranged to correspond to the sides of a triangle. One of the seat support members is removably connected between the front legs of the chair by means of a longitudinally extendable pin associated with said support member. The two remaining seat support members are respectively connected between the front legs of the chair and a particular coupling assembly.

By virtue of the coupling assembly, the two aforementioned seat support members are adapted to be moved towards one another through a horizontal plane, whereby to cause the front and back legs, the back support members, and the arm support members to come together along a vertical plane. The front and back legs and the back and arm support members are adapted to be rotated through the vertical plane and into the horizontal plane of the seat support members, so that in a folded configuration, each of the structural members of the present folding chair can be compactly arranged in substantially parallel alignment with one another and generally in a single (horizontal) plane.

DESCRIPTION OF THE PREFERRED EMBODIMENT

Figure 1:
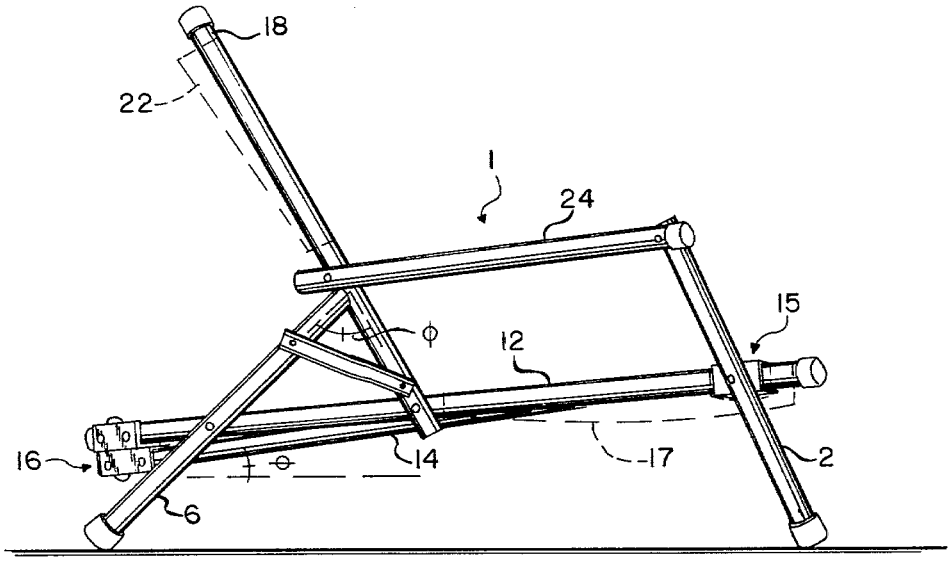
FIG. 1 shows a side view of the frame that forms the folding chair of the present invention.
Figure 2:
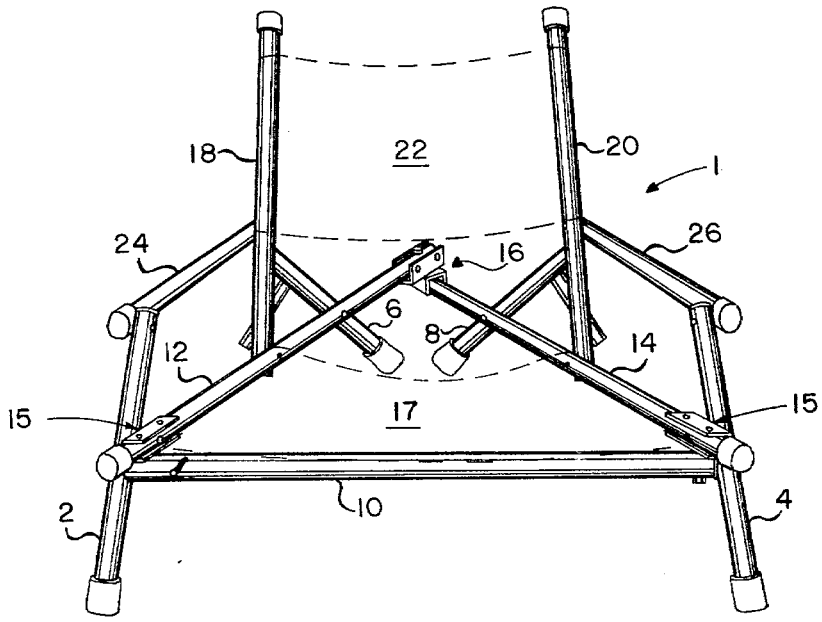
FIG. 2 shows a front perspective view of the frame that forms the folding chair of FIG. 1.

The compact, comfortable, and sturdy folding chair 1 that forms the present invention is disclosed in detail while referring to the drawings. Referring concurrently to FIGS. 1 and 2 and in accordance with the instant invention, the folding chair 1 is provided with a plurality of structural support members that are interconnected, so as to form an improved frame which enhances the ease and efficiency by which the chair may be folded into a convenient configuration that consumes relatively little space. More particularly, the frame of chair 1 includes a pair of front legs 2 and 4 and a pair of back legs 6 and 8. As will be appreciated by those skilled in the art, the legs of conventional folding chairs are typically arranged in a substantially rectangular configuration. However, the legs 2, 4, 6, and 8 of the present folding chair 1 are aligned relative to one another to form a base that is substantially triangular in configuration. That is, legs 2 and 4 are spaced from one another and represent two vertices of a triangle. Back legs 6 and 8 are spaced relatively closely to one another, whereby to essentially form the third vertex of the triangle.

As will also be recognized by those skilled in the art, the seat support of conventional folding chairs is, likewise, typically arranged in a rectangular configuration. However, and as is best illustrated in FIG. 2, the formation of the seat support of the instant folding chair 1 comprises a plurality of structural support members that are arranged relative to one another to form the sides of a triangle. More particularly, the seat support of chair 1 includes a first structural support member 10 positioned between the front legs 2 and 4 and removably connected at front leg 2. A second structural support member 12 is connected from front leg 2, by means of a first coupling assembly 15, to a second coupling assembly 16. A third structural support member 14 is connected from front leg 4, by means of an identical coupling assembly 15, to the coupling assembly 16. Seat support members 10 and 14 are pivotably interconnected with one another by means of the last-mentioned coupling assembly 15, so that the position of support member 10 can be changed relative to that of support member 14. As will be more clearly illustrated when referring to FIG. 6 of the drawings, the triangular configurations into which both the seat support and the base comprising the legs of the chair are arranged permit the structural members of the chair to be easily folded into a compact and substantially parallel alignment with one another to thereby facilitate either the storage or transport thereof. The seat support members 12 and 14 are also respectively connected to the back legs 6 and 8 by means of rivets, pins, or the like connecting means which permit the back legs to be pivoted therearound. Details of the coupling assemblies 15 and 16 and the particular interconnection of seat support members 10, 12, and 14 with the legs of the folding chair 1 will be described in greater detail when referring to FIGS. 3–5 of the drawings, hereinafter.

A seat portion 17 for chair 1 may be fabricated from any suitable material that is cut into a convenient (e.g. trapezoidal) shape to be wrapped (and sewn) around seat support members 12 and 14. The seat support structure may (gently) recline in the assembled relationship of chair 1 from the front to the back thereof, so as to form an angle, designated $\theta$, with a horizontal surface upon which the chair is placed. The reclining seat support structure contributes to the comfort of a user sitting upon the seat portion 17.

The folding chair 1 of the present invention also includes pairs of back support members 18 and 20 and arm support members 24 and 26. Back support members 18 and 20 extend generally upward and in parallel directions relative to one another. In the assembled relationship, back support members 18 and 20 are disposed in a direction that angles away from a vertical line of reference. Such alignment further contributes to the comfort of the user. Back support members 18 and 20 are respectively connected at first ends thereof to the seat support members 12 and 14 by means of rivets, pins, or the like, which connection means permit the back support members to be pivoted therearound. The upper-most ends of each of the back legs 6 and 8 are machined so that, in the assembled relationship, the back legs 6 and 8 respectively abut the sides of back support members 18 and 20. However, suitable brackets may be pivotably connected between the back support members and the back legs, so as to provide additional structural support therebetween. Hence, and unlike many conventional folding chairs, wherein the back and leg supports are aligned in a substantially planar configuration with one another, the back support members 18 and 20 and the back legs 6 and 8 of the present invention respectively intersect one another to form an angle, designated $\phi$, therebetween. By way of example, the angle $\phi$ made by a back support member (e.g. 18) and a back leg (e.g. 6) is approximately 45°. This aforementioned alignment of the back supports and the back legs of chair 1 advantageously maximizes the stability of said chair, while reducing the adverse effects of shock or vibration applied thereto. A back rest portion 22 of suitable material is cut into a convenient (e.g. rectangular) shape to be extended between and wrapped (and sewn) around second ends of the back support members 18 and 20. By way of example, both the seat and back rest portions 17 and 22 may be fabricated from any well known and environmentally resistant material such as canvas, nylon, or the like fabrics.

The arm support members 24 and 26 extend in generally horizontal and parallel directions relative to one another. Arm support members 24 and 26 are respectively connected between front leg members 2 and 4 and back support members 18 and 20 by means of rivets, pins, or the like, which connecting means permit the arm support members to be pivoted therearound.

Each of the front and back legs 2, 4, 6, and 8; the seat support members 10, 12, and 14; the back support members 18 and 20; and the arm support members 24 and 26, that are interconnected with one another as hereinbefore disclosed to form the structure of an improved frame for the folding chair 1 of the present invention, is fabricated from any suitable and preferably lightweight material. By way of particular example, the aforementioned structural members may be fabricated from hollow (tubular) extrusions of aluminum, or the like, material.

Figure 3:
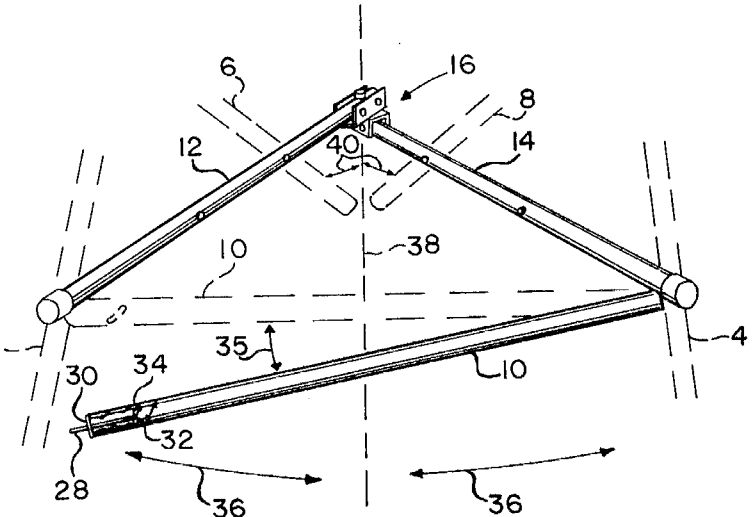
FIG. 3 is a detailed illustration of the structure and operation of the seat support of the present folding chair.

Referring now to FIG. 3 of the drawings, the structure of and the corresponding manner in which the triangularly shaped seat support (comprising support members 10, 12 and 14) operates in the present folding chair are disclosed in detail. As already disclosed, a first end of the hollow seat support member 10 is pivotably interconnected with the seat support member 14 by means of a coupling assembly 15, so that the second end of support member 10 is adapted to be disconnected from front leg 2 and moved in either of the directions, as indicated by the arrows 35. The second end of support member 10 (which is shown partially cut away) is particularly fabricated, whereby to facilitate the removable connection of seat support member 10 to the front leg 2. More particularly, one end of an elongated pin or rod 28 may be either extended or retracted in a direction along the longitudinal axis of seat support member 10. A cap or similar end piece 30 is positioned at the second end of support member 10. Cap 10 has an opening formed therein, whereby to guide an extension of pin 28 therethrough. The other end of the pin 28 is connected to an arm 32, so that the pin 28 and arm 32 are aligned in a substantially perpendicular relationship with one another. The arm 32 extends through a slot 34 which is formed (i.e. cut) in the side of support member 10. In operation, the arm 32 is adapted to be manually driven through slot 34 in a direction whereby to cause a corresponding extension or retraction of the elongated rod 28 through cap 30. Therefore, when it is desirable to assemble the folding chair, the first end of the seat support member 10 is moved into a position adjacent the front leg 2. The operator thereupon moves arm 32 through slot 34, so as to cause pin 28 to extend through cap 30 for engagement by a suitably sized aperture (not shown) formed in the front leg 2. The position of the seat support member 10 in the assembled (i.e. unfolded) condition between front legs 2 and 4 is represented by dotted lines in FIG. 3.

Figure 4:
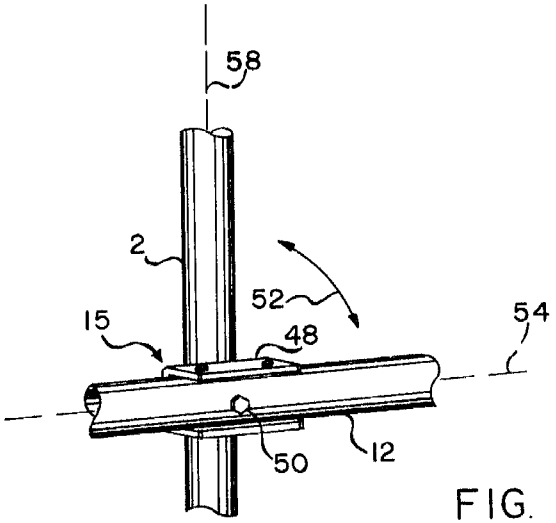
FIGS. 4 and 5 show different coupling assemblies that are particularly fabricated to facilitate an efficient and compact folding of the presently disclosed chair.

As was previously disclosed, and as best shown in FIGS. 1 and 2 of the drawings, seat support members 12 and 14 are respectively connected between coupling assemblies 15 and 16. Referring concurrently to FIGS. 3 and 4 of the drawings, a first of the aforementioned coupling assemblies 15 is now described. For purposes of convenience, only the coupling assembly 15 which is associated with seat support member 12 and front chair leg 2 is described in detail hereat. However, it is to be understood that the companion coupling assembly 15 which is associated with seat support member 14 and front chair leg 4 is identical in structure to that which is to be disclosed below. Coupling assembly 15 comprises a section of rectangular channel 48 that may be fabricated from aluminum, steel, or any other suitable material. One end of seat support member 12 is received by channel section 48, so that the longitudinal axis of support member 12 (as represented by the dotted line 54) lies in a generally horizontal plane that is approximately parallel to the surface upon which the chair is placed. The longitudinal axis (not shown) of support member 14 lies substantially in the same horizontal plane as line 54. In the assembled or unfolded relationship, the longitudinal axis of front leg 2 (as represented by the dotted line 58) lies in a generally vertical plane, which plane is aligned approximately perpendicular to the horizontal plane of line 54. Channel section 48 is preferably positioned so that the flat face thereof lies between seat support member 12 and the front chair leg 2. A suitable fastening means, such as a bolt 50, or the like, connects support member 12 and channel section 48 to the front chair leg 2. By virtue of channel section 48, the front leg 2 may be easily pivoted around fastening means 50 in either of the directions represented by the arrows 52.

In operation, and when it is desirable to fold the chair into a compact configuration, each front leg (e.g. 2) thereof is rotated through a respective vertical plane, such as that represented by the line 58, until the front legs 2 and 4 are moved into substantial alignment with the horizontal plane that is common to seat support members 12 and 14. It has been found that the inclusion of the coupling channel section 48 between support member 12 and front leg 2 advantageously minimizes the adverse effects of many physical forces (e.g. such as those attributable to stress which is induced as a consequence of rotating leg 2 relative to support member 12) that are applied to fastening means 50. Such physical forces have been known to promote an early shearing or fracturing and thereby reduce the life of fastening bolt 50 in prior art folding chairs in which such a bolt, or similar fastening means, is employed.

As previously disclosed and as best shown in FIGS. 1 and 2, the front and back chair legs 2, 4, 6, and 8, the back support members, and the arm support members are pivotably interconnected with the seat support to form the improved frame for the folding chair in the present invention. Therefore, the above-described folding of front legs 2 and 4 in a direction indicated by arrows 52 and into the horizontal plane common to seat support members 12 and 14 correspondingly causes each of the aforementioned structural members to be, likewise, rotated into said horizontal plane (represented by the line 54 in FIG. 5).

Figure 5:
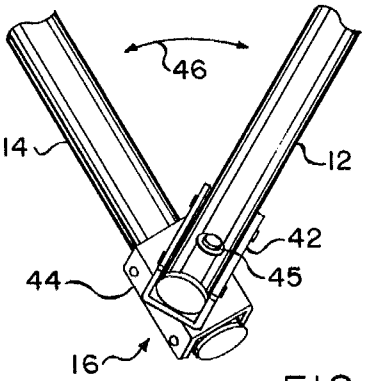

Coupling assembly 16, which interconnects the second ends of seat support members 12 and 14 to one another, is now described while referring concurrently to FIGS. 3 and 5 of the drawings. Coupling assembly 16 comprises a pair of identical coupling members 42 and 44. Each of coupling members 44 and 42 of assembly 16 is similar in configuration to the coupling members (e.g. 48) that forms the coupling assembly 15 of FIG. 4. That is, each of the coupling members 42 and 44 comprises a section of rectangular channel fabricated from a suitable material such as aluminum, steel, or the like. The second end of each of the seat support members 12 and 14 is respectively received by coupling members 42 and 44. Coupling members 42 and 44 are positioned opposing one another in a face-to-face arrangement. Hence, the second end of seat support member 12 is positioned over the second end of seat support member 14 at the coupling assembly 16. A fastening means, such as a pin 45, or the like, interconnects the second end of support member 12 and coupling member 42 with coupling member 44 and the second end of support member 14 so that each of the seat support members 12 and 14 may be easily pivoted around pin 45 and through the above-mentioned horizontal plane thereof in either of the directions represented by the arrows 46 of FIG. 5. Accordingly, and with seat support member 10 disconnected from front leg 2, each of the front, 2 and 4, and back, 6 and 8, legs of the folding chair can be moved in either of the respective directions represented by the arrows 36 and 40 in FIG. 3.

During the operation of folding the presently disclosed chair, seat support member 10 is disconnected from front leg 2, in a manner as previously disclosed. Support member 10 is rotated through the horizontal plane (represented by line 54 in FIG. 4) between seat support members 12 and 14 and moved into a position under seat support member 14 and in parallel alignment therewith. By virtue of coupling assembly 16, seat support members 12 and 14 are rotated in directions towards one another through the aforementioned horizontal plane until said support members are substantially adjacent one another. Therefore, each of the front and back legs 2, 4, 6, and 8 are likewise moved towards one another until said members lie substantially adjacent one another. As is best illustrated in FIG. 3, each of the structural members forming the frame of the present folding chair can be moved into respective positions substantially adjacent one another along a vertically disposed plane, represented by the dotted line 38. The front legs 2 and 4 of the chair may then be rotated through the vertical plane 38 (in a direction represented by arrows 52 and in a manner similar to that disclosed when referring to FIG. 4), whereby to cause the front and back legs, the back support members, and the arm support members of the present folding chair to lie in the horizontal plane of seat support members 12 and 14.

Figure 6:
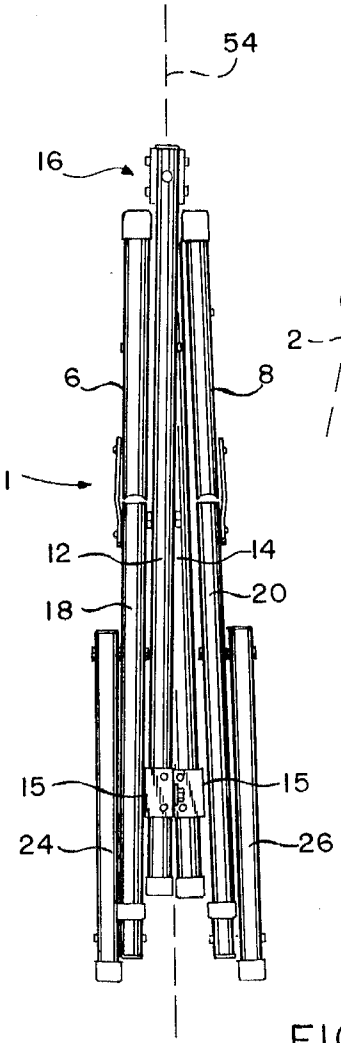
FIG. 6 represents the present chair in a folded condition with each of the structural members of the frame thereof arranged in substantially parallel alignment with the another and generally in a single plane.

FIG. 6 of the drawings illustrates the folding chair of the present invention compactly folded so that the structural members thereof are arranged in substantially parallel alignment with one another and generally in a single horizontal plane, as represented by the dotted line 54. The folded configuration of FIG. 6 shows (for convenience) only back legs 6 and 8, seat support members 12 and 14, back support members 18 and 20, and arm support members 24 and 26. However it is to be understood that the remaining structural members (which are not shown) of the improved chair frame are also arranged in substantially parallel alignment with and generally in the (horizontal) plane of the aforementioned illustrated structural members.

Figure 7:
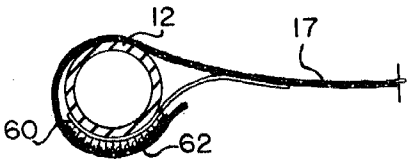
FIG. 7 illustrates a modification of the instant invention for attaching a seat rest portion to the seat support of the present folding chair.

FIG. 7 of the drawings shows a modification of the present invention. In order to facilitate an easy attachment or removal of either of the seat or back rest portions 17 and 20 (best illustrated in FIGS. 1 and 2 of the drawings), the seat and back rest portions may be removably secured to respective structural members of the chair frame. By way of particular example, the seat portion 17 may be attached to any of its corresponding seat support members (e.g. 12) by means of a self-adhering material, such as that generally known as Velcro. More particularly, a piece 60 of Velcro material is conveniently positioned on the surface of seat support member 12. A companion piece of Velcro material 62 is suitably located at one end of seat portion 17, so that when seat portion 17 is wrapped around support member 12, opposing Velcro pieces 60 and 62 interlock with one another in mating engagement. Such an arrangement as illustrated in FIG. 7 advantageously eliminates many of those problems inherent in a seat portion that has heretofore been permanently secured (e.g. sewn) around its corresponding support member. However, it is to be understood that the folding chair hereinbefore disclosed may be folded into a compact configuration regardless of whether or not the seat and back rest portions have been removed therefrom.

It will be apparent that while a preferred embodiment of the invention has been shown and described, various modifications and changes may be made without departing from the true spirit and scope of the invention. For example, by virtue of the coupling assemblies 15 and 16 and the improved frame disclosed above, the structural members of the present folding chair are adapted to be moved in one or both of two generally perpendicular directions (i.e. through the vertical and horizontal planes represented by lines 38 and 54, respectively). However, it is to be understood that the order of the perpendicular directions in which the structural members are moved may be selected according to the convenience of the user. In addition, the structural members comprising the chair frame may be selected with a rectangular, rather than a round, cross-section. In this case, coupling assemblies 15 and 16 can either be eliminated or replaced by flat coupling members.

Having thus set forth a preferred embodiment of the present invention, what is claimed is:

1. A folding chair comprising:

first and second seat support members, leg means pivotably connected to said seat support members, back support means pivotably connected to said seat support members, first coupling means to pivotably interconnect said first and second seat support members, said first and second seat support members adapted for movement in a horizontal plane and in directions toward one another, whereby to correspondingly cause said leg means and said back support means to be moved in directions respectively towards one another, and a third seat support member pivotably connected between said first and second seat members and adapted for movement in the horizontal plane of said first and second seat support members, said leg means and said back support means adapted to be pivoted through respective vertical planes and into the horizontal plane of said first, second, and third seat support members, so that in a folded configuration, each of said seat support members, said leg means, and said back support means is compactly arranged in substantially parallel alignment with one another in said horizontal plane.

2. The folding chair recited in claim 1, wherein said first coupling means includes a pair of flat sections positioned in face-to-face alignment with one another, each of said flat sections being interfaced with one end of one of said first and second seat support members, and retaining means to interconnect said pair of flat coupling sections in said face-to-face alignment between said first and second seat support members.

3. The folding chair recited in claim 2, wherein said first coupling means comprises a pair of rectangular channel portions, each of said channel portions receiving therein one of said first and second seat support members.

4. The folding chair recited in claim 1, further comprising second coupling means to pivotably interconnect said leg means to said seat support members.

5. The folding chair recited in claim 4, wherein said second coupling means includes a flat section interfaced with said leg means, and retaining means to interconnect said flat coupling section between said leg means and said seat support members.

6. The folding chair recited in claim 5, wherein said second coupling means comprises a rectangular channel portion to receive therein said leg means.

7. The folding chair recited in claim 1, wherein a first end of said third seat support member is pivotably connected to one of said first and second seat support member, and the second end of said third seat support member is removably connected to said leg means.

8. The folding chair recited in claim 7, wherein the second end of said third seat support member includes an elongated pin means associated therewith, and means by which to cause said pin means to be extended from or retracted into said third member, whereby to removably connect said second end to said leg means.

9. The folding chair recited in claim 7, further comprising second coupling means to pivotably interconnect the first end of said third seat support member and said leg means with the one of said first and second seat support members, and retaining means for accomplishing the aforementioned interconnections, whereby said third seat support member is adapted for movement in a direction through the horizontal plane and said leg means is adapted for movement in a direction through the vertical plane.

10. The folding chair recited in claim 1, further comprising arm support means pivotably interconnected between said leg means and said back support means and adapted for movement in a direction through the vertical plane.

11. A folding chair having at least front legs and a plurality of at least three seat support members, all of which being pivotably interconnected with one another, said folding chair further including:

first coupling means for pivotably interconnecting first ends of a first and second of said seat support members, second coupling means for pivotably interconnecting the second end of the first of said seat support members to one front leg, third coupling means for pivotably interconnecting the second end of the second of said seat support members to another front leg, and fourth coupling means for pivotably interconnecting one end of a third of said seat support members to the second end of one of said first or second seat support members, said third seat support member extending between the second ends of said first and second seat support members, each of said front legs and said first, second and third seat support members being movable in one or both of two generally perpendicular directions so as to be compactly positioned in substantially parallel alignment with one another.

12. The folding chair recited in claim 11, wherein said first coupling means comprises a pair of rectangular channel portions positioned in face-to-face alignment with one another, each of said channel portions respectively receiving the first end of one of said first and second seat support members.

13. The folding chair recited in claim 11, wherein each of said second and third coupling means comprises a rectangular channel portion, each of said channel portions respectively receiving the second ends of said first and second seat support members.

14. The folding chair recited in claim 11, wherein the third of said plurality of seat support members, is removably connected between the one and the other of said front legs.

15. The folding chair recited in claim 11, wherein the second end of said third seat support member includes retaining means associated therewith, and means by which to cause said retaining means to be extended from or retracted into said third member in order to thereby removably connect the second end of said third member to one of said front legs.

16. A folding chair having a compact folded configuration and comprising a plurality of leg means and at least first, second and third seat support members for forming a seat upon which to support the weight of a user thereupon, said leg means and seat support members being pivotably interconnected with one another, the second of said seat support members being pivotably connected between the first and third of said seat support members, each of said first, second, and third seat support members being rotatable through a horizontal plane, so as to be located in generally parallel alignment with and adjacent one another, and each of said plurality of leg means being pivotably connected to said seat support members, so as to be rotatable through respective vertical planes and located in generally parallel alignment with and adjacent said seat support members.

17. The folding chair recited in claim 16, wherein said first, second, and third seat support members are pivotably interconnected with one another so as to form a triangular seat for supporting the weight of a user thereupon.

* * * * *